US005471848A

United States Patent [19]

Major et al.

[11] Patent Number: 5,471,848

[45] Date of Patent: Dec. 5, 1995

[54] REFRIGERANT RECOVERY AND PURIFICATION METHOD AND APPARATUS

[76] Inventors: Thomas O. Major, 4105 Gray, Denver, Colo. 80212; Jack E. Major, Jr., 1590 Harlan, Lakewood, Colo. 80214

[21] Appl. No.: 177,742

[22] Filed: Jan. 5, 1994

[51] Int. Cl.[6] ..... F25B 45/00

[52] U.S. Cl. ..... 62/149; 62/77

[58] Field of Search ..... 62/292, 149, 77

[56] References Cited

U.S. PATENT DOCUMENTS 5,167,126 12/1992 Cartwright ..... 62/292

*Primary Examiner*—John M. Sollecito
*Attorney, Agent, or Firm*—J. Preston Oxenham

[57] ABSTRACT

A refrigerant recovery apparatus for removing refrigerant from a refrigeration unit includes a pump for pumping refrigerant gas. A first channel for conducting refrigerant from a fluid circuit of a refrigeration unit to the pump has an upstream end with a coupler for coupling the first channel in fluid communication with a refrigeration unit fluid circuit. The first channel downstream end is connected to the pump's suction side. A second channel for conducting fluid from the pump to a refrigerant storage container has an upstream end connected to the high-pressure side of the pump and a downstream end with a coupler for coupling the second channel in fluid communication with a refrigerant storage vessel. The recovery unit further includes a fluid vessel, a first fluid communication path for placing the vessel in fluid communication with the first fluid channel, and a second fluid communication path for placing the vessel in fluid communication with the second fluid channel. A controller opens and closes first and second valves to selectively block the first and second fluid communication paths, respectively. The controller has a first mode in which the first fluid path is open and the second fluid path is closed and a second mode in which the first path is closed and the second path is open.

15 Claims, 3 Drawing Sheets

REFRIGERANT RECOVERY AND PURIFICATION METHOD AND APPARATUS

TECHNICAL FIELD

The present invention relates to apparatus for recovery and purification of refrigerant charges contained in refrigerating systems. More particularly, the present invention relates to apparatus for recovering refrigerant from a refrigerating system prior to repair or replacement of the refrigerating system and purifying the charge for reuse in that or another system.

BACKGROUND OF THE INVENTION

Traditionally, when refrigerant charged refrigeration systems were repaired, the refrigerant charge was simply loosed to the atmosphere as necessary to accomplish the repairs. In recent times, it has become increasingly desirable to capture and reuse the refrigerant charges for a number of reasons; refrigerant pollution of the atmosphere is perceived as environmentally destructive, government regulations now limit the release of fluorocarbon refrigerants to the atmosphere, and the cost of refrigerant materials has increased making the disposal and replacement of the refrigerant charge increasingly costly.

Refrigerant recovery devices of the prior art have drawn refrigerant from the fluid circuits of charged refrigeration systems, compressed and cooled the refrigerant to a liquid state, and, in some cases purified the refrigerant, for storage and reintroduction to the same refrigeration system after repair has been accomplished or for use in other refrigeration systems. Increasingly stringent government regulation limiting the release of refrigerants to the atmosphere require that recovery systems pull increasingly deep vacuums on the refrigeration fluid circuit to satisfactorily complete the recovery process. To achieve such vacuums, recovery apparatus of the prior art have utilized two pumps, generally a centrifugal compressor, which is utilized until a vacuum begins to form in the refrigeration system fluid circuit, and a positive displacement vacuum pump, which draws refrigerant fluid from the circuit after a predetermined negative gauge pressure is achieved.

The positive displacement pumps of the prior art devices must operate at high compression ratios to draw a sufficiently deep vacuum on a refrigeration which increases wear and the incidence of damage to pump motors and valves. The presence of two pumps increases the cost, mechanical complexity and weight of these recovery systems of the prior art. Further, maintenance costs of these systems are high because two different types of pumps must be maintained and, thus, parts must be inventoried and service persons trained for each.

BRIEF DESCRIPTION OF THE INVENTION

It is an object of the present invention to provide a refrigerant purification and recovery apparatus which can draw a deep vacuum on a refrigeration system fluid circuit to effectively complete a refrigerant recovery operation.

It is also an object of the present invention to provide a refrigerant purification and recovery apparatus which minimizes the compression ratio which must be achieved by the recovery apparatus pump to draw a sufficiently deep vacuum on a refrigeration system.

It is a further object of the present invention to provide a refrigerant purification and recovery apparatus which is not mechanically complex.

It is a another object of the present invention to provide a refrigerant purification and recovery apparatus which is light in weight and compact.

It is a yet another object of the present invention to provide a refrigerant purification and recovery apparatus which is easily maintained.

It is also an object of the present invention to provide a refrigerant purification and recovery apparatus which is relatively inexpensive to manufacture and economical to operate.

A refrigerant recovery apparatus comprising an embodiment of the present invention includes a compressor for compressing refrigerant gas and a first fluid channel with an upstream end including a coupler for coupling the channel in fluid communication with the fluid circuit of a refrigeration unit and a downstream end connected to the suction side of the compressor. A second fluid channel has an upstream end connected to a high-pressure side of the compressor and a downstream end with a coupler for coupling the channel in fluid communication with a refrigerant storage vessel. An internal refrigerant containment vessel may be placed in fluid communication with the first fluid channel by opening a valve in a first vessel communication conduit running from the vessel to the first channel and placed in fluid communication with the second fluid channel by opening a valve in a second vessel communication conduit running from the vessel to the second channel. The second fluid channel also has a valve downstream of the second conduit attachment point for closing off fluid communication between the attachment point and the refrigerant storage container coupler at the downstream end of the second fluid channel. A pressure sensing device is located in the first fluid channel to measure the fluid pressure in the first channel and generate a pressure signal to a control device.

During the early phases of a refrigerant recovery operation, the internal refrigerant containment vessel is placed in fluid communication with the first fluid channel by opening the first fluid conduit valve and isolated from the second channel by closing the second fluid conduit valve until the pressure in the first channel becomes less than a predetermined pressure. Once the pressure in the first channel has become less than a predetermined pressure, fluid communication between the high pressure port of the compressor and the refrigerant storage vessel is blocked by closing the second fluid channel valve, fluid communication is established between the internal vessel and the second fluid channel by opening the second conduit valve and, fluid communication between the vessel and the first fluid channel is blocked by closing the first conduit valve. This reduces the pressure differential over the compressor and allows a deeper vacuum to be drawn on the refrigeration unit fluid circuit.

In an alternative embodiment, a bifurcated conduit has a trunk end and a bifurcated end with first and second branches. The trunk end is provided with a coupler for coupling the conduit trunk in fluid communication with a refrigerant storage container. The first branch is joined in fluid communication with the first channel and the second branch is joined in fluid communication with the second channel. A three port valve at the juncture point of the trunk and two branches alternatively places the trunk in fluid communication with the first or second branch.

In a third embodiment, the pressure differential over the compressor is measured and the vessel taken out of fluid communication with the first channel and placed in communication with the second channel when the pressure differential exceeds a predetermined pressure differential.

From the above description, it may be seen that a method of the present invention for drawing a vacuum in the refrigerant fluid circuit of a refrigeration unit to complete a refrigerant recovery process utilizing a refrigerant recovery device having a compressor, a first fluid channel leading from the refrigerant fluid circuit of the refrigeration unit to a suction side port of the compressor and a second fluid channel leading from a high pressure side port of the compressor to a refrigerant storage vessel includes the steps of energizing the compressor of the recovery device to perform a recovery operation, providing a fluid containment vessel, establishing fluid communication between the vessel and the first fluid channel, waiting until a pressure in the first channel is less than a predetermined pressure and,once the pressure is less than the predetermined pressure, blocking fluid communication between the high pressure port and the refrigerant storage vessel at a block point in the second channel, establishing fluid communication between the vessel and a portion of the second fluid channel between the high pressure port and the block point and blocking fluid communication between the vessel and the first fluid channel.

Other objects, advantages and aspects of the invention will become apparent upon reading of the following detailed description and claims and upon reference to the accompanying drawings.

DETAILED DESCRIPTION OF THE INVENTION

Figure 1:
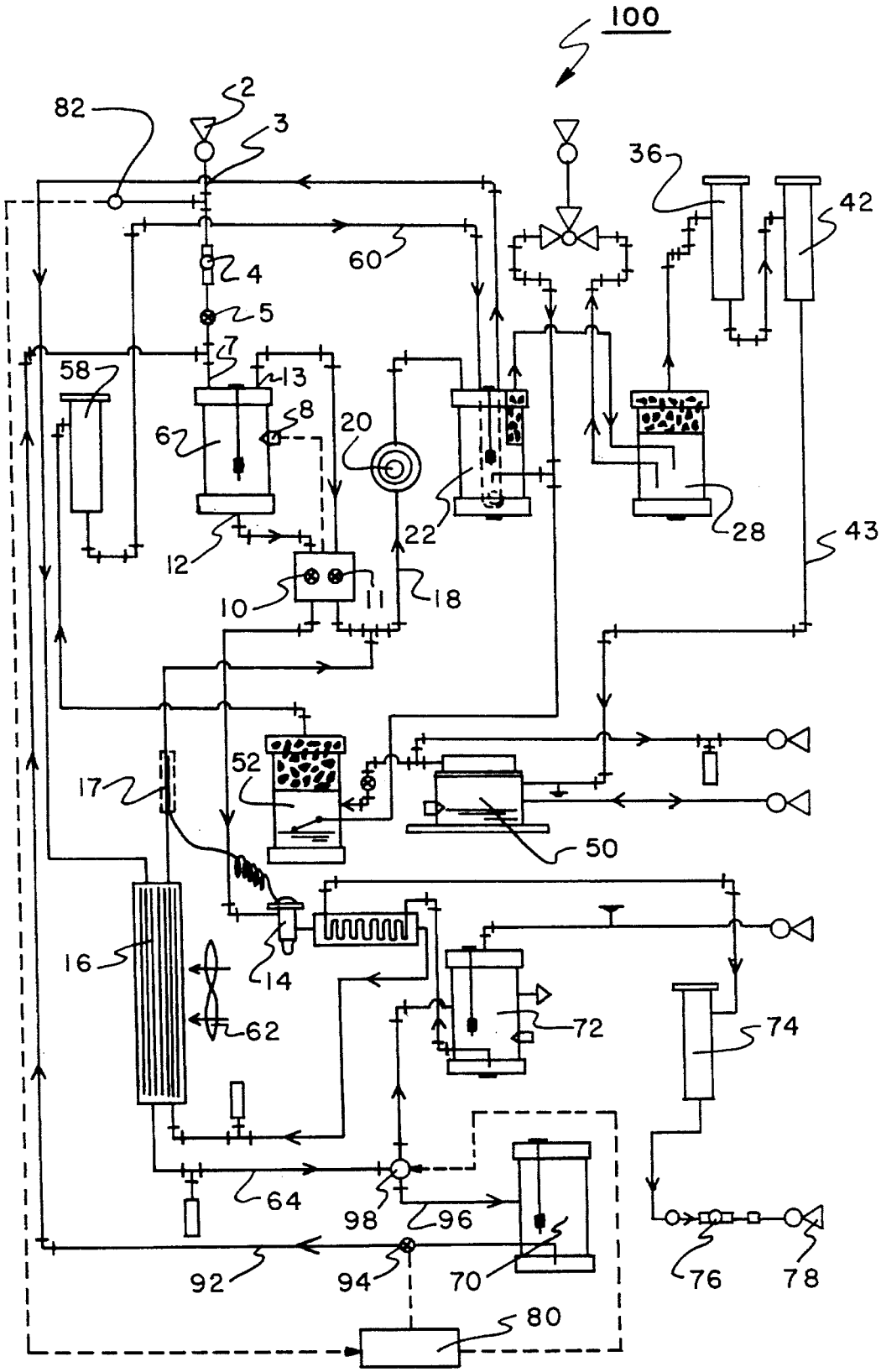
FIG. 1 is a schematic drawing of a refrigerant purification and recovery apparatus comprising a preferred embodiment of the present invention.

Refrigerant purification and recovery apparatus 100 comprising an exemplary preferred embodiment of the present invention is shown schematically in FIG. 1. When refrigerant purification and recovery apparatus 100 is in use, inlet 2 is connected in fluid communication with the fluid circuit of a refrigeration unit from which refrigerant is to be removed by utilizing a fluid conduit, such as a suction hose, adapted for connection to a connector provided on the refrigeration unit, generally near the suction side of the refrigerant unit compressor. When the recovery-purification process is begun by opening an outlet valve on the refrigeration unit and providing power to compressor 50 of recovery-purification apparatus 100, refrigerant is drawn from the refrigeration unit through inlet 2, conduit 3, particulate filter 4, solenoid valve 5 and through conduit 7 into phase separator vessel 6.

Flow of refrigerant from separator vessel 6 is controlled by solenoid valves 10 and 11 in accordance with signals generated by liquid level sensor 8, which may be, for example, a float type sensor or a photoelectric sensor. Normally, when a presence of liquid refrigerant is detected by sensor 8, valve 10 is in an open position while valve 11 is closed, such that liquid refrigerant flows from separator vessel 6 through lower outlet 12 and valve 10, is throttled through temperature expansion valve 14, and flows through an evaporator core of condenser-evaporator 16 to be warmed by heat exchange with the ambient atmosphere such that the flow becomes substantially of gaseous phase before it is introduced into conduit 18.

When a presence of liquid refrigerant is not detected by sensor 8, valve 10 is placed in a closed position while valve 11 is placed in an open position, such that gaseous refrigerant flows from separator vessel 6 through upper outlet 13 and valve 11 into conduit 18. Gas phase refrigerant flows from conduit 18, through compressor pressure regulator valve 20, first stage oil removal element 22, second stage oil removal element 28, first oil polisher 36, vapor acid filter 42 and conduit 43 to compressor 50.

After compression by compressor 50, the hot, compressed refrigerant gas flows through hot-gas oil trap 52 and oil polisher 58. The hot, gaseous refrigerant then flows through oil trap 52; oil removal element 58; conduit 60, which includes a coil portion within the canister of oil removal element 22 over which heat transfer occurs to cool the hot flowing gas and warm accumulated oil within the canister; and through a condenser core of evaporator-condenser 16, where the refrigerant is further cooled by heat transfer to the ambient atmosphere. Cooling of the refrigerant gas in the condenser core of evaporator-condenser 16 may be augmented by fan 62.

After cooling in the condenser core, the refrigerant flows to receiver-separator vessel 72 for purging of noncompressible gas contaminates as is described in detail in U.S. Pat. No. 5,078,756. From receiver-separator vessel 72, the refrigerant, now substantially in liquid phase, flows through liquid moisture filter 74 and particulate filter 76 to outlet 78, which is connected to a refrigerant storage vessel.

Exemplary refrigerant purification and recovery apparatus 100 comprising a preferred embodiment of the present invention includes internal refrigerant containment vessel 70. Upstream vessel conduit 92 leads from refrigerant containment vessel 70 to a point in the refrigerant flow channel of recovery apparatus 100 upstream of compressor 50 such that vessel 70 may be put, selectively, in fluid communication with the upstream refrigerant flow channel by opening valve 94, and isolated from the upstream channel by closing valve 94. Downstream vessel conduit 96 leads from vessel 70 to three port, two-way valve 98 located in the refrigerant flow channel of recovery apparatus 100 at a point downstream of compressor 50. When three port, two-way valve 98 is in a first condition, vessel 70 is isolated from the downstream channel portion and receiver-separator 72 is in fluid communication with downstream channel portion 64. When three port, two-way valve 98 is in a second condition, vessel 70 is in fluid communication with downstream channel portion 64 and receiver-separator 72 is isolated from downstream channel portion 64. Valves 94 and 98 are, for example, solenoid valves and are controlled by controller 80 in response to pressure signals received from pressure sensor 82 which senses the pressure in upstream channel portion 3.

When a recovery operation is begun, controller 80 places refrigerant apparatus 100 in a first configuration in which valve 94 is in its open position, placing vessel 70 in fluid communication with the upstream, low-pressure portion of the refrigerant channel of refrigerant recovery device 100 and three-port valve 98 is in its first condition to isolate vessel 70 from the downstream, high-pressure portion of the refrigerant channel. As the recovery operation progresses, the pressure of refrigerant within conduit 3 will continuously decrease, and presser sensor 82 will begin to sense a negative gauge pressure as compressor 50 of recovery apparatus 100 begins to pull a vacuum on the refrigerant fluid circuit of the refrigeration system from which refrigerant is being recovered. As, in this first configuration, vessel 70 is in fluid communication with the low-pressure channel portion at conduit 7, a vacuum will be pulled in vessel 70 which is generally equivalent to that being drawn on the refrigeration system refrigerant circuit. When controller 80 receives a signal from sensor 82 indicating that the pressure in the upstream fluid channel at conduit 3 is less than a predetermined pressure, controller 80 places recovery apparatus 100 in a second configuration, causing valve 98 to be placed in its second condition, isolating receiver-separator 72 from downstream channel portion 64 and placing vessel 70 in fluid communication with downstream refrigerant channel portion 64, and causing valve 94 to be placed in a closed position, isolating vessel 70 from the upstream channel portion. Establishing communication of vessel 70 with downstream portion 64 reduces the pressure on the high pressure side of compressor 50 which reduces the differential pressure and compression ratio over compressor 50. Thus, compressor 50 can draw a deeper vacuum on the upstream channel and the refrigerant circuit of the refrigeration system.

Figure 2:
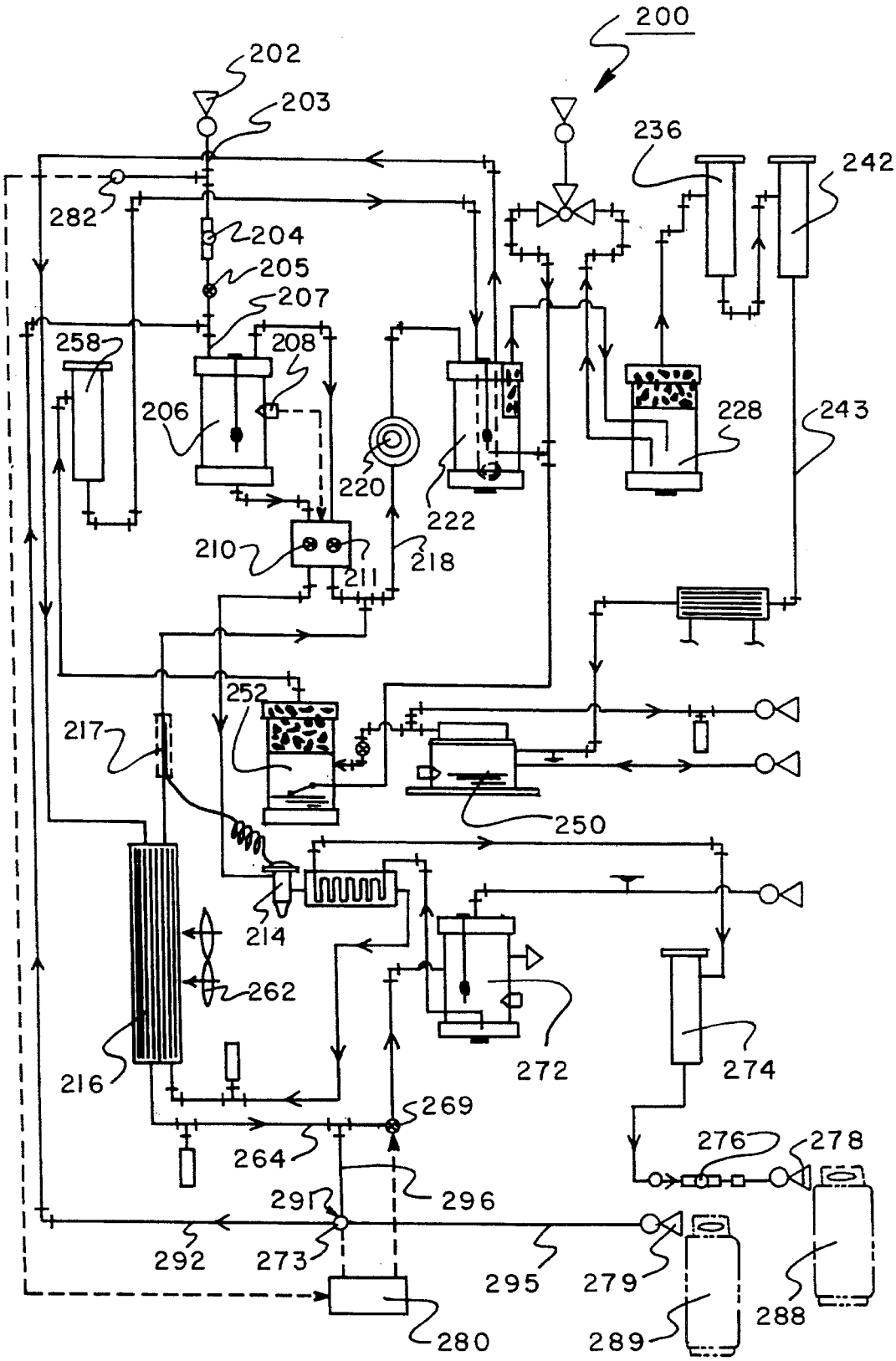
FIG. 2 is a schematic drawing of a refrigerant purification and recovery apparatus comprising an alternative embodiment of the present invention.

Exemplary refrigerant purification and recovery apparatus 200 comprising a second embodiment of the present invention is shown, in schematic, in FIG. 2. In that figure, similar numbers identify elements similar to those of the exemplary apparatus of FIG. 1. Primary refrigerant storage container 288 and secondary refrigerant storage container 289 are shown in phantom in FIG. 2, and are coupled in fluid communication with refrigerant recovery apparatus 200 by couplers 278 and 279, respectively. In exemplary recovery apparatus 200 comprising the alternative embodiment, secondary refrigeration storage vessel 289 is utilized to reduce the compression ratio required over compressor 250 to draw a deep vacuum on the refrigerant circuit of a refrigeration system in the same manner that vessel 70 is utilized to reduce the required compression ratio over compressor 50 in the embodiment of exemplary recovery apparatus 100 of FIG. 1.

Bifurcated vessel conduit 291 includes trunk portion 295 and two branch portions, upstream branch portion 292, which is connected to the upstream portion of the refrigerant channel of recovery apparatus 200 on the low pressure side of compressor 250 at conduit 207, and downstream branch portion 296, which is connected to downstream portion 264 of the refrigerant channel on the high pressure side of compressor 250 of recovery device 200. Valve 273 is a three port, two way valve. When valve 273 is in a first condition, trunk conduit portion 295 of bifurcated conduit 291 is in fluid communication with upstream branch 292 and isolated from downstream branch 296. When valve 273 is in a second condition, trunk conduit portion 295 of bifurcated conduit 291 is in fluid communication with downstream branch 296 and isolated from upstream branch 292. Downstream shutoff valve 269 allows fluid communication between receiver-separator 272 and downstream portion 264 and branch 296 when it is in an open position and isolates receiver-separator 272 from downstream portion 264 and branch 296 when it is in a closed position.

When a recovery operation is begun, controller 280 places refrigerant recovery apparatus 200 in a first configuration in which three-port valve 273 is in its first condition, placing secondary refrigerant storage tank 289 in fluid communication with the upstream, low-pressure portion of the refrigerant channel and isolating secondary refrigerant storage tank 289 from the down stream, high-pressure portion of the refrigerant channel of refrigerant recovery device 200, and valve 269 is in its open position to allow fluid communication between downstream portion 264 and receiver-separator 272. As the recovery operation progresses, the pressure in conduit 203 will continuously decrease, and pressure sensor 282 will begin to sense a negative gauge pressure as compressor 250 of recovery apparatus 200 begins to pull a vacuum on the refrigerant fluid circuit of the refrigeration system from which refrigerant is being recovered. In this first configuration, secondary tank 289 is in fluid communication with the low-pressure channel portion at conduit 207 and a vacuum will be pulled in secondary tank 289 which is generally equivalent to that being drawn on the refrigeration system refrigerant circuit. When controller 280 receives a signal from sensor 282 indicating that the pressure in the upstream fluid channel at conduit 207 is less than a predetermined pressure, controller 280 places recovery apparatus 200 in a second configuration, causing valve 269 to be placed in its closed condition, isolating receiver-separator 272 from downstream channel portion 264 and branch 296, and causing valve 273 to be placed in its second condition, isolating secondary tank 289 from the upstream channel portion and establishing communication of secondary tank 289 with downstream portion 264. This reduces the pressure in downstream portion 264 and at the high pressure port of compressor 250 and, thus, reduces the differential pressure and compression ratio over compressor 250. Compressor 250 can then draw a deeper vacuum on the upstream channel and the refrigerant circuit of the refrigeration system.

From the description of refrigerant recovery apparatus 100 and 200 comprising a first embodiment and an alternative embodiment of the present invention, respectively, it may be understood that a method of the present invention for drawing a deep vacuum on the refrigerant fluid circuit of a refrigeration unit to complete a refrigerant recovery process includes the steps of energizing the compressor of the recovery apparatus to perform a recovery operation, providing a fluid containment vessel, establishing fluid communication between the containment vessel and the upstream portion of the fluid channel of the recovery apparatus, waiting until a pressure in the upstream channel is less than a predetermined pressure and, upon the pressure becoming less than the predetermined pressure, blocking fluid communication between the high pressure port of the compressor and the refrigerant storage vessel at a block point in the downstream channel, establishing fluid communication between the containment vessel and a portion of the downstream fluid channel between the high pressure port and the block point and blocking fluid communication between the containment vessel and the upstream fluid channel.

Figure 3:
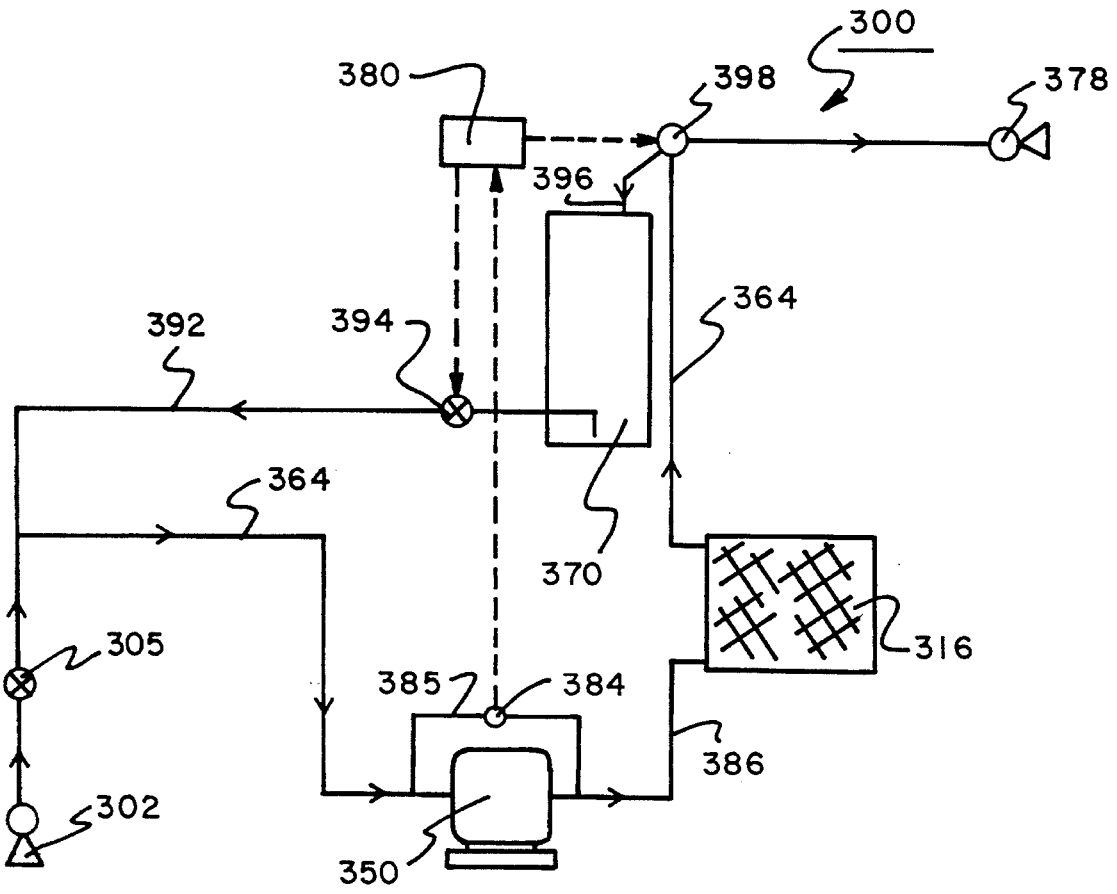
FIG. 3 is a schematic drawing of a refrigerant recovery apparatus comprising a third embodiment of the present invention.

Exemplary refrigerant recovery apparatus 300 comprising a third embodiment of the present invention is shown, in schematic, in FIG. 3. In that figure, as in FIG. 2 above, similar numbers identify elements similar to those of the exemplary apparatus of FIGS. 1 and 2. Exemplary refrigerant purification and recovery apparatus 300 includes internal refrigerant containment vessel 370. Upstream vessel conduit 392 leads from refrigerant containment vessel 370 to a point in the refrigerant flow channel of recovery apparatus 300 upstream of compressor 350 such that vessel 370 may be put, selectively, in fluid communication with the upstream refrigerant flow channel by opening valve 394, and isolated from the upstream channel by closing valve 394. Downstream vessel conduit 396 leads from vessel 370 to three port, two-way valve 398 located in the refrigerant flow channel of recovery apparatus 300 at a point downstream of compressor 350 and condenser 316. When three port, two-way valve 398 is in a first condition, vessel 370 is isolated from downstream channel portion 364, and outlet port 378 is in fluid communication with the high pressure side of compressor 350. When three port, two-way valve 398 is in a second condition, vessel 370 is in fluid communication with downstream channel portion 364, and outlet port 378 is isolated from the high pressure side of compressor 350.

Valves 394 and 398 are controlled by controller 380 in response to pressure signals received from differential pressure sensor 384. Differential pressure sensor 384 has a high pressure side in fluid communication with upstream channel portion 354 by means of upstream differential pressure sensor conduit 385 and a low pressure side in fluid communication with downstream channel portion 364 by means of downstream differential pressure sensor conduit 386, and generates a signal indicative of the pressure differential over compressor 350 to controller 380.

When a recovery operation is begun, controller 380 places refrigerant apparatus 300 in a first configuration in which valve 394 is in its open position, placing vessel 370 in fluid communication with upstream, low-pressure portion 364 of the refrigerant channel of refrigerant recovery device 300 and three-port valve 398 is in its first condition to isolate vessel 370 from downstream, high-pressure portion 364 of the refrigerant channel. As the recovery operation progresses, the differential pressure over compressor 350 will continuously increase as the pressure in the refrigeration system refrigerant fluid circuit and upstream channel portion 364 is reduced and the pressure in the refrigerant storage container to which port 378 is attached and the pressure in downstream channel portion 364 increase. With the recovery apparatus in the first configuration, vessel 370 is in fluid communication with upstream, low-pressure channel portion 364, and the pressure in vessel 370, generally, will be equivalent to that of the refrigeration system refrigerant circuit. When controller 380 receives a signal from differential pressure sensor 384 indicating that the pressure differential over compressor 350 is greater than a predetermined differential pressure, controller 380 places recovery apparatus 300 in a second configuration, causing valve 398 to be placed in its second condition, isolating port 378 from downstream channel portion 364 and placing vessel 370 in fluid communication with downstream refrigerant channel portion 364, and causing valve 394 to be placed in a closed condition , isolating vessel 370 from upstream channel portion 364. Establishing communication between vessel 370 and downstream channel portion 364 reduces the pressure in channel portion 364 and, thus, the differential pressure and compression ratio over compressor 350. This allows compressor 350 to further reduce the pressure in upstream channel portion 364 and the refrigerant circuit of the refrigeration system.

From the description of exemplary refrigerant recovery apparatus 300, it may be seen that a method of the present invention for drawing a deep vacuum on the refrigerant fluid circuit of a refrigeration unit to complete a refrigerant recovery process includes the steps of energizing the compressor of the recovery apparatus to perform a recovery operation, providing a fluid containment vessel, establishing fluid communication between the containment vessel and the upstream portion of the fluid channel of the recovery apparatus, waiting until a pressure differential over the compressor is greater than a predetermined pressure differential and, upon the pressure differential becoming greater than the predetermined pressure differential, blocking fluid communication between the high pressure port of the compressor and the refrigerant storage vessel at a block point in the downstream channel, establishing fluid communication between the containment vessel and a portion of the downstream fluid channel between the high pressure port and the block point, and blocking fluid communication between the containment vessel and the upstream fluid channel.

While exemplary refrigeration purification and recovery apparatus comprising a preferred embodiments of the present invention have been shown, it will be understood, of course, that the invention is not limited to those embodiments. Modification may be made by those skilled in the art, particularly in light of the foregoing teachings. For example, a positive displacement pump, or a combination of centrifugal compressor and positive displacement pump, might be substituted for the compressor of the described embodiments. It is, therefore, contemplated by the appended claims to cover any such modification which incorporates the essential features of this invention or which encompasses the spirit and scope of the invention.

We claim:

1. A refrigerant recovery apparatus for removing refrigerant from a refrigeration unit comprising:

pump means for pumping refrigerant has:

first channel means for conducting refrigerant from a fluid circuit of the refrigeration unit to said pump means, said first channel means having an upstream end and a downstream end, said first channel means upstream end including coupling means for coupling said first channel means in fluid communication with a refrigeration unit fluid circuit, said first channel means downstream end connected to a suction side of said pump means:

second channel means for conducting fluid from a high pressure side of said pump means to a refrigerant storage container, said second channel means having an upstream end and a downstream end, said second channel means upstream end connected to a high-pressure side of said pump means, said second channel means downstream end including coupling means for coupling said second channel means in fluid communication with a refrigerant storage vessel:

vessel means for containing a fluid:

first vessel fluid communication path means for placing said vessel means in fluid communication with said first fluid channel means:

second vessel fluid communication path means for placing said vessel means in fluid communication with said second florid channel means:

first blocking means for selectively blocking said first fluid communication path means, said first blocking means having an open position in which fluid communication is established and a closed position in which fluid communication is not established;

second blocking means for selectively, blocking said second fluid communication path means, said second blocking means having an open position in which fluid communication is established and a closed position in which fluid communication is not established: and, control means for opening and closing said first and second blocking means, said control means having a first mode in which said first blocking means is open and said second blocking means is closed and a second mode in which said first blocking means is closed and said second blocking means is open.

2. A refrigerant recovery apparatus as in claim 1, further comprising:

pressure sensing means for sensing a pressure in said first channel means and generating a signal indicative of the pressure to said control means and said control means assumes said first mode when said signal is indicative of a pressure greater than a predetermined pressure and assumes said second mode when said signal is indicative of a pressure less than a predetermined pressure.

3. A refrigerant recovery apparatus as in claim 2, further comprising:

valve means within said second channel means for selectively placing said pump means in fluid communication with said refrigerant storage vessel, said valve means having an open position in which fluid communication is established and a closed, position in which fluid communication is not established.

4. A refrigerant recovery apparatus as in claim 3 in which said third valve means is a check valve.

5. A refrigerant recovery apparatus as in claim 3, further comprising:

said control means opens and closes said valve means placing said valve means in the open position when said control means is in said first mode and placing said valve means in the closed position when said control means is in said second mode.

6. A refrigerant recovery apparatus as in claim 5, in which said control means comprises a microprocessor and a solenoid.

7. A refrigerant recovery apparatus as in claim 1 in which said first vessel fluid communication path means and said second vessel fluid communication path means have a common fluid communication path means portion.

8. A refrigerant recovery apparatus as in claim 7 in which said first and second blocking means comprise a three port valve having two positions, a first position in which a first port is in fluid communication with a second port and not in fluid communication with a third port and a second position in which the first port is in fluid communication with the third port and not in fluid communication with the second port.

9. A refrigerant recovery apparatus as in claim 1, further comprising:

differential pressure sensing means for sensing a differential pressure between the suction side of said pump and the high pressure side of said pump and generating a signal indicative of the differential pressure to said control means and said control means assumes said first mode upon initiation of a recovery operation and, upon said signal becoming indicative of a differential pressure greater than a predetermined differential pressure, said controller assumes said second mode.

10. A refrigerant recovery apparatus for removing refrigerant from a refrigeration unit comprising:

pump means for pumping refrigerant gas;

first channel means for conducting refrigerant from a fluid circuit of the refrigeration unit to said pump means, said first channel means having an upstream end and a downstream end, said first channel means upstream end including coupling means for coupling said first channel means in fluid communication with a refrigeration unit fluid circuit, said first channel means downstream end connected to a suction side of said pump means;

second channel means four conducting fluid from a high pressure side port of said pump means to a primary refrigerant storage container, said second channel means having an upstream end and a downstream end, said second channel means upstream end connected to a high-pressure side of said pump means, said second channel means downstream end including coupling means for coupling said, second channel means in fluid communication with a primary refrigerant storage container;

bifurcated conduit means for alternatively placing a secondary refrigerant storage container in fluid communication with said first fluid channel means or placing the secondary refrigerant storage container in fluid communication with said second fluid channel means, said bifurcated conduit means comprising a trunk end and first and second branch ends, said trunk end including coupling means for coupling said bifurcated conduit means in fluid communication with a secondary refrigerant storage container, said first bifurcated end attached in fluid communication to said first channel means, said second bifurcated end attached in fluid communication with said second channel means at an attachment point, and further comprising selection means for selecting between a first and second mode such that fluid communication is established between said trunk end and said first branch end put not between said trunk end and said second branch end when the first mode is selected and fluid communication is established between said trunk end and said second branch end but not between said trunk end and said first branch end when the second mode is selected; and, valve means for selectively blocking said second channel means at a point between said attachment point and said downstream end, said valve means having a first mode in which fluid communication is established between said attachment point and said downstream end and a second mode in which fluid communication between said attachment point and said downstream end is blocked.

11. A refrigerant recovery apparatus as in claim 10 in which said selection means is a three port valve.

12. A refrigerant recovery apparatus as in claim 10, further comprising:

control means for placing said selection means and said valve means in said first and second modes, said control means having a first mode in which said selection means and said valve means are placed in their first mode and a second mode in which said selection means and said valve means are placed in their second mode.

13. A refrigerant recovery apparatus as in claim 12, further comprising:

pressure sensing means for sensing a pressure in said first channel means and generating a signal indicative of the pressure to said control means and said control means assumes said first mode when said signal is indicative of a pressure greater than a predetermined pressure and assumes said second mode when said signal is indicative of a pressure less than a predetermined pressure.

14. A refrigerant recovery apparatus as in claim 13, in which said control means comprises a microprocessor and a solenoid 15. A refrigerant recovery apparatus as in claim 11, further comprising:

differential pressure sensing means for sensing a differential pressure between the suction side of said pump and the high pressure side of said pump and generating a signal indicative of the differential pressure to said control means and said control means assumes said first mode upon initiation of a recovery operation and, upon said signal becoming indicative of a differential pressure greater than a predetermined differential pressure, said controller assumes said second mode.

* * * * *